US007758035B2

(12) United States Patent
Tamura et al.

(10) Patent No.: US 7,758,035 B2
(45) Date of Patent: Jul. 20, 2010

(54) SHEET POST-PROCESSING APPARATUS

(75) Inventors: Hitoshi Tamura, Hachioji (JP); Masaaki Uchiyama, Hachioji (JP); Tsuyoshi Shiokawa, Hachioji (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 107 days.

(21) Appl. No.: 11/826,643

(22) Filed: Jul. 17, 2007

(65) Prior Publication Data

US 2008/0061501 A1 Mar. 13, 2008

(30) Foreign Application Priority Data

Sep. 11, 2006 (JP) ..... 2006-245365

(51) Int. Cl.
*B65H 33/04* (2006.01)
*B65H 39/00* (2006.01)

(52) U.S. Cl. ..... 270/58.07; 270/58.08; 270/58.09; 270/58.11; 270/58.12

(58) Field of Classification Search ..... 270/58.07, 270/58.08, 58.09, 58.11, 58.12
See application file for complete search history.

(56) References Cited

U.S. PATENT DOCUMENTS 5,690,324 A * 11/1997 Otomo et al. ..... 270/58.02
6,270,067 B1 * 8/2001 Bergmann et al. ..... 270/13
6,375,180 B1 * 4/2002 Kawano et al. ..... 270/58.09

FOREIGN PATENT DOCUMENTS

JP 5-254704 10/1993
JP 05254704 A * 10/1993
JP 9-235069 9/1997
JP 09235069 A * 9/1997

OTHER PUBLICATIONS

National Aeronautics and Space Administation; Newton's Second Law of Motion: Definitions; located at www.grc.nasa.gov/WWW/K-12/airplane/newton2.html.*

* cited by examiner

*Primary Examiner*—Gene Crawford
*Assistant Examiner*—Yolanda Cumbess
(74) *Attorney, Agent, or Firm*—Finnegan, Henderson, Farabow, Garrett & Dunner, L.L.P.

(57) ABSTRACT

A sheet post-processing apparatus including:

a sheet conveying section for conveying sheets to an intermediate stacker by a plurality of conveying rollers containing a conveying roller capable of changing the pressing force against an opposing roller; and a control section wherein, when the first sheet to be assigned to a succeeding bundle of sheets has passed through the conveying roller capable of changing the aforementioned pressing force, and has arrived upstream from the aforementioned intermediate stacker during post-processing a preceding bundle of sheets, the pressing force of the conveying roller capable of changing the aforementioned pressing force is made smaller than the value at the time of conveyance; and after a second sheet has passed through the conveying roller capable of changing the aforementioned pressing force, the pressure is changed to the value at the time of the conveyance.

8 Claims, 6 Drawing Sheets

SHEET POST-PROCESSING APPARATUS

This application is based on Japanese Patent Application No. 2006-245365 filed on Sep. 11, 2006, in Japanese Patent Office, the entire content of which is hereby incorporated by reference.

TECHNICAL FIELD

The present invention relates to a sheet post-processing apparatus for post-processing the sheets having been fed from an image forming apparatus.

BACKGROUND

In a sheet post-processing apparatus, the sheets sent from the image forming apparatus of a photocopier or printer are sequentially stacked on an intermediate stacker, and these sheets are arranged to form a bundle of sheets. The bundle of sheets having been formed is subjected to various forms of post-processes such as stitching by a stapler. This sheet post-processing apparatus has been put into common use over an extensive field.

With an increase in the operation speed of the image forming apparatus, the aforementioned sheet post-processing apparatus is required to enhance the throughput, and several techniques have been proposed.

In the conventional sheet post-processing apparatus, when a process of stitching the sheet bundle mounted on an intermediate stacker is finished, several sheets of paper are placed sequentially from the top sheet on the intermediate stacker in order to form a bundle of sheets for the next process of stitching.

One proposal for increasing speed is as follows. While a process of stitching is applied to the bundle of sheets placed on the intermediate stacker, two leading sheets out of the sheets for forming a bundle of sheets to be subjected to the next stitching operation are placed one on top of another on the sheet conveyance path located immediately before the intermediate stacker. Upon completion of the process of stitching the preceding bundle of sheets the sheets are fed out to the intermediate stacker. This is intended to reduce the overall time of forming the bundle of sheets (e.g., Unexamined Japanese Patent Application Publications No. H5-254704 and No. H9-235069).

However, even when the sheets are waiting on the sheet conveyance path, some of the conveying rollers arranged on the sheets conveyance path rotate in contact with the sheets. This may cause the waiting sheets to be scratched or contaminated.

SUMMARY

In view of forgoing, one embodiment according to one aspect of the present invention is a sheet post-processing apparatus which executes a post-process on a sheet bundle, the sheet post-processing apparatus comprising: a post-processing device for executing the post-process on the sheet bundle;

an intermediate stacker which is provided upstream of the post-processing device in a sheet conveyance direction for stacking sheets to be post-processed;

a conveying roller which is provided upstream of the intermediate stacker in the sheet conveyance direction, a pressing force of the conveying roller against a facing roller being variable; and a controller for controlling the pressing force of the conveying roller, wherein after a leading edge of a first sheet to be assigned to a succeeding sheet bundle goes through the conveying roller while the post-processing device executes the post-process on a preceding sheet bundle, the controller changes a pressing force of the conveying roller from a first pressing force to a second pressing force which is smaller than the first pressing force, and then the controller changes the pressing force of the conveying roller to the first pressing force after a leading edge of a second sheet to be assigned to the succeeding sheet bundle goes through the conveying roller.

DETAILED DESCRIPTION OF THE PREFERRED EMBODIMENT

Figure 1:
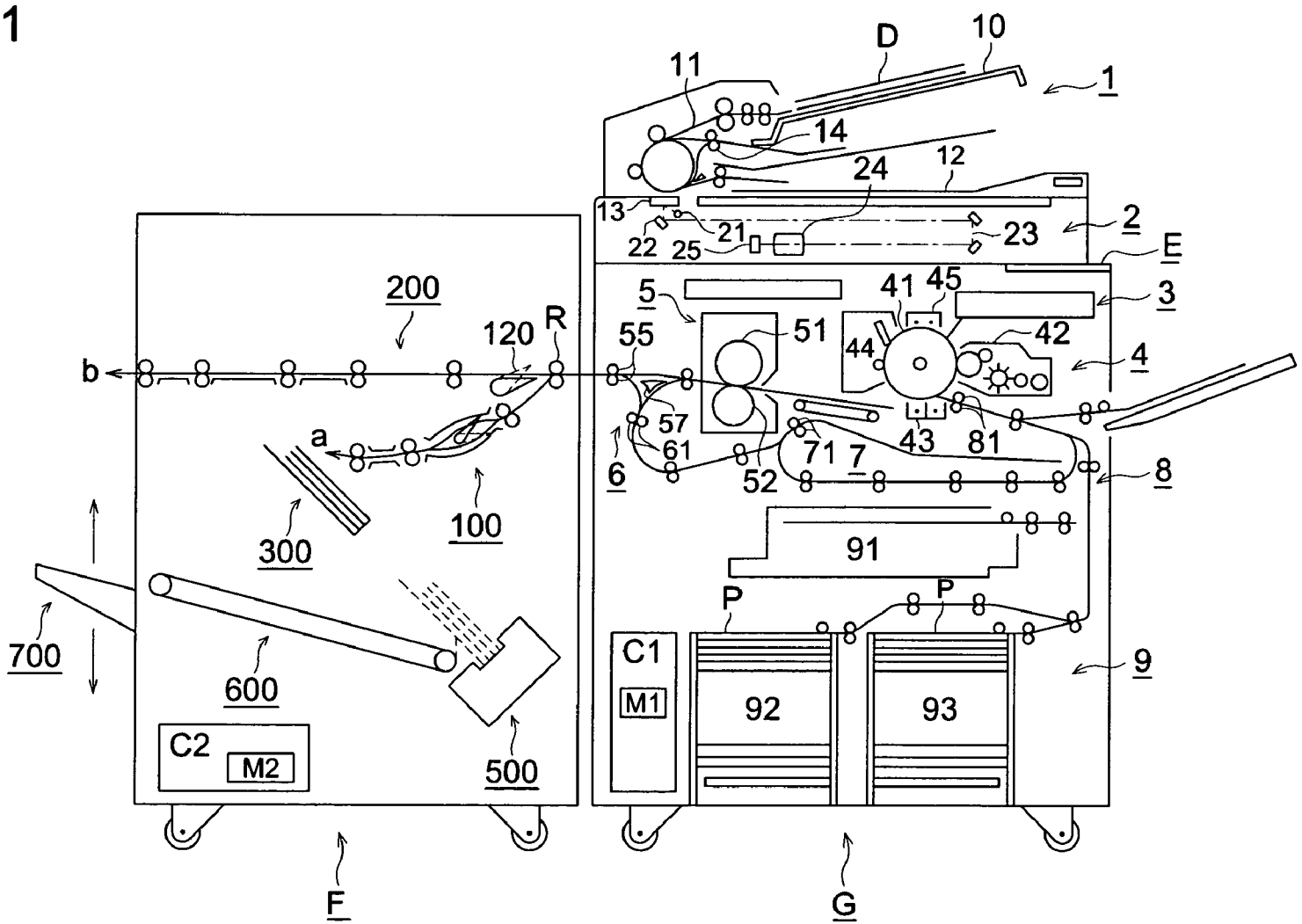
FIG. 1 is a conceptual diagram representing the image forming system wherein an image forming apparatus is connected with a sheet post-processing apparatus.

The following describes the embodiments of the present invention with reference to drawings:

FIG. 1 is a conceptual diagram representing the image forming system wherein an image forming apparatus G is connected with a sheet post-processing apparatus F.

The image forming apparatus G is a digital photocopier to form an image using electrophotographic process. It is provided with an automatic document feed apparatus 1 on the top and is connected with a sheet post-processing apparatus F on the left.

The image forming apparatus G includes an automatic document feed apparatus 1, reading section 2, writing section 3, image forming section 4, fixing section 5, sheet reversing and ejecting section 6, sheet re-feed section 7, sheet conveying section 8, sheet feed section 9, control section C1, operation and display section E and others.

The automatic document feed apparatus 1 sends the documents D of the document platen 10 one by one to the document sheet conveyance path 11, and ejects them to the document ejection platen 12. The image surface of the document D being conveyed is read by the reading section 2 at a document reading position 13. When images on both sides of the document D are read, the document D whose first side has been read is reversed by a reversing section 14, and is fed out again to the document sheet conveyance path 11. Then the second side is read and the document is ejected to the document ejection platen 12.

The reading section 2 includes a light source 21, first mirror unit 22, second mirror unit 23, imaging lens 24, CCD25 and others. It scans the image on the document D traveling through the image reading position 13 so that the image is formed on the CCD25. Then the document image information as optical information is converted into electrical information. After being subjected to such processing as A/D conversion, shading correction and compression, the document image information having been converted is stored in the memory M1 of the control section C1.

The writing section 3 is comprised of an optical scanning system made up of a laser light source, cylindrical lens, Fθ lens, mirror and polygon. Using the laser beam that changes in response to the image information read out of the aforementioned memory M1, the writing section 3 scans the surface of the photoreceptor 41 of the image forming section 4, and forms a latent image on the surface of the aforementioned photoreceptor 41.

The image forming section 4 allows the latent image formed on the surface of the photoreceptor 41 to be developed by the developing section 42, whereby the latent image is developed into a visible toner image. The transfer section 43 permits the aforementioned toner image to be transferred onto the sheets (sheets) P fed out by the registration roller 81. The residual toner is removed by a cleaning section 44 from the surface of the photoreceptor having finished the transfer of the toner image, and electric charge is provided by a charging section 45 to prepare for formation of the next latent image.

The fixing section 5 uses a heating roller 51 and pressure roller 52 arranged face to face with each other to heat and press the sheet P carrying a toner image so that the toner image is fixed onto the sheet P.

The sheet P with the image having been fixed thereon is fed to the post-processing apparatus F by the sheet ejection roller 55.

When the sheet P is reversed and ejected, the sheet P is led downward by the sheet ejection guide 57. The trailing edge of the aforementioned sheet P is sandwiched by the reversing rollers 61 of the reversing section, and the sheet is then reversed and fed out to the sheet ejection roller 55.

When an image is formed on both sides of the sheet P, the sheet P is fed to the sheet re-feed section 7 by the sheet ejection guide 57 and a plurality of rollers, and the sheet P is reversed by the reversing roller 71 of the sheet re-feed section 7. Then the sheet is fed out again to the sheet conveying section 8.

The sheet conveying section 8 conveys the sheets P having been sent out from the sheet feed section 9, along the sheet conveyance path made up of a plurality of rollers and guide member. After the leading edge of the sheet P has been brought in contact with the registration roller 81, the sheet is fed toward the photoreceptor 41 so that the toner image will be received.

The sheet feed section 9 has a first sheet feed section 91 having a tray of smaller storage capacity, and a second sheet feed section 92 and a third sheet feed section 93 having a tray of greater storage capacity.

The operation and display section E is a touch panel provided on the top surface of the main body of the image forming apparatus G. It has both display and input functions, and is used to set the number of sheets to be copied, and to give instructions on whether a post-process is applied to the outputted copy or not, for example.

As illustrated, the sheet post-processing apparatus F is made of a first conveying section 100, second conveying section 200, sheet stacking section 300, a post-processing device such as stitching section 500, third conveying section 600, sheet ejection tray 700, sheet conveyance path switching member 120, controller such as control section C2 and others.

The first conveying section 100 as a sheet conveying section forming a sheet conveyance path that sends sheets P in the direction marked by arrow "a" includes a plurality of conveying rollers containing the conveying rollers capable of changing the pressing force between opposing rollers, a plurality of guide plates and a distributing guide.

The sheet P ejected from the image forming apparatus G is led to the first conveying section 100 by the incoming roller R of the sheet post-processing apparatus F and the sheet conveyance path switching member 120 at the dotted position in the drawing. The sheet P having been fed is sent to the sheet stacking section 300 by the first conveying section 100.

The bundle of sheets stacked and sorted out by the sheet stacking section 300 is stitched by the stitching section 500 as a post-processing section. The bundle of sheets having been stitched is ejected out of the apparatus by the third conveying section 600, and is mounted on the sheet ejection tray 700 that can be elevated.

The second conveying section 200 constituting the sheet conveyance path that leads the unstitched sheets P in the direction of arrow "b" also includes a plurality of conveying rollers and a plurality of guide plates. The sheets P having been sent from the image forming apparatus G are ejected in the direction of arrow "b" and are stacked on the sheet ejection tray 700 located upward.

Figure 2:
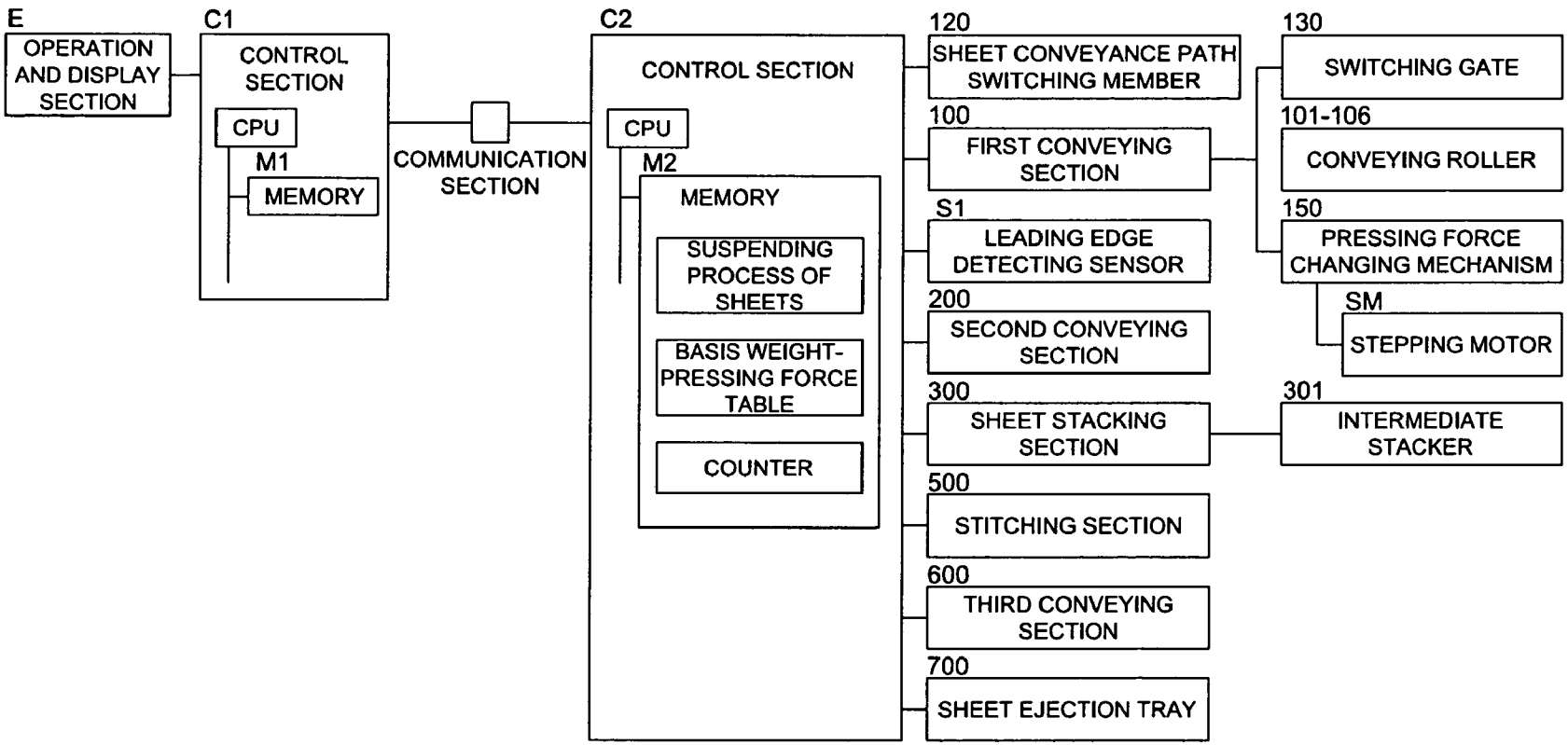
FIG. 2 is a block diagram representing the control relevant parts in an image forming system.

FIG. 2 is a block diagram representing the control relevant parts in the image forming system.

Both the control section C1 of the image forming apparatus G and the control section C2 of the sheet post-processing apparatus F are computer systems containing a CPU, memory, input/output interface, drive circuit and others. Each part is controlled by a predetermined program stored in the memory.

The control section C1 and control section C2 exchange information through a communications section.

FIG. 2 does not include the blocks that are not directly related to the description of the present invention.

Figure 3:
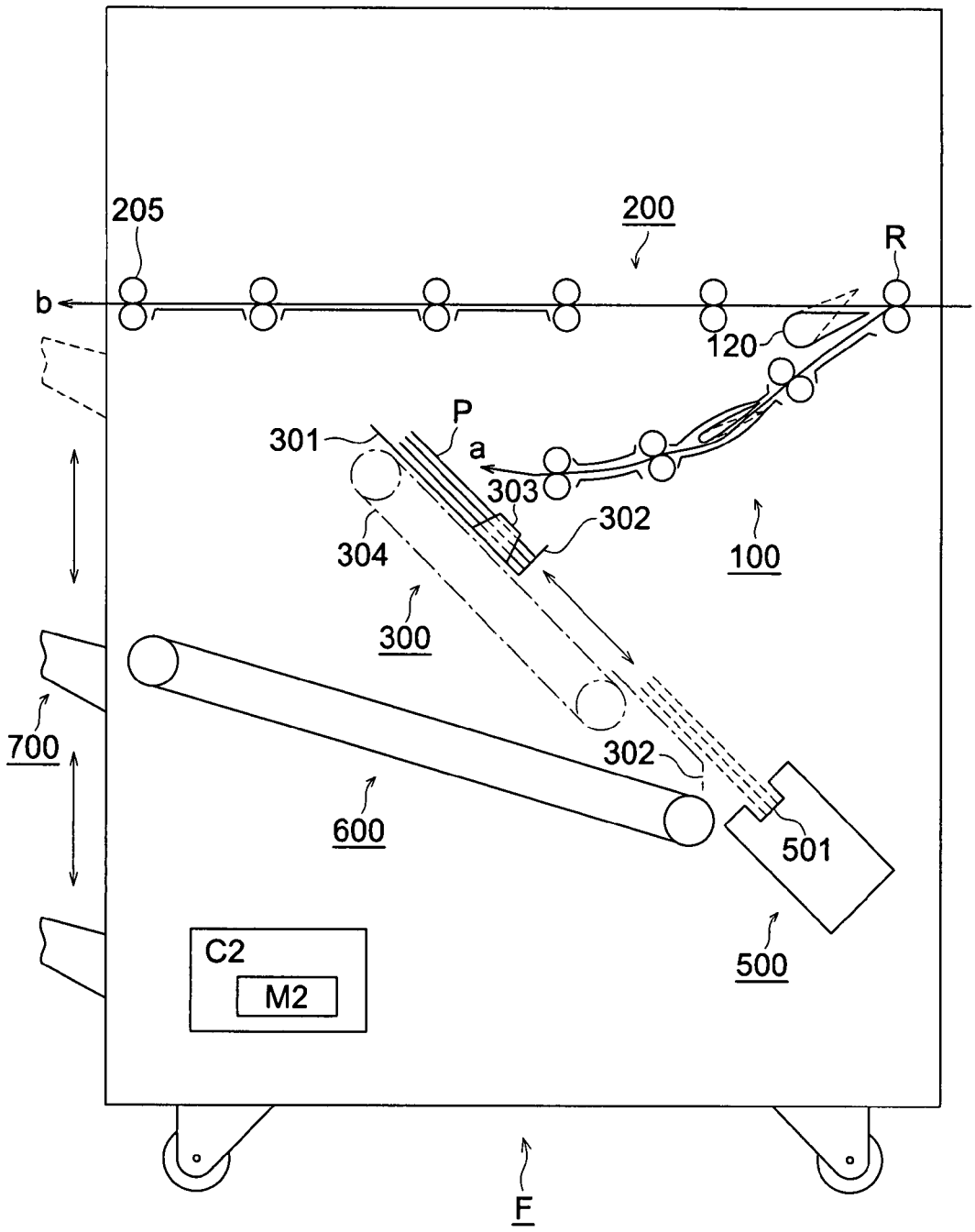
FIG. 3 is a conceptual diagram representing a sheet post-processing apparatus.

FIG. 3 is a conceptual diagram representing the sheet post-processing apparatus F.

As described above, when a non-stitch mode has been selected on the operation and display section E of the image forming apparatus G, the sheet P is led to the second conveying section 200 by the incoming roller R of the post-processing apparatus F and the sheet conveyance path switching member 120 located at the solid line position in the drawing. The sheet P is then fed in the direction of arrow "b" and is ejected into the sheet ejection tray 700.

If the stitch mode has been set on the operation and display section E of the image forming apparatus G, the sheet P is led to the first conveying section 100 by the incoming roller R of the post-processing apparatus F and the sheet conveyance path switching member 120 located at the dotted position in the drawing. The sheets P fed to the first conveying section 100 are conveyed in the direction of arrow "a", and are fed out to the sheet stacking section 300.

The sheet stacking section 300 includes an intermediate stacker 301 for sequentially stacking the sheets P having been conveyed by the first conveying section 100, and forming a bundle of sheets; a leading edge hitting plate 302 for aligning the leading edges of the bundle of sheets placed on the intermediate stacker 301; an edge guide 303 for aligning the side edge of the bundle of sheets; and an intermediate stacker moving section 304.

The sheets P stacked sequentially on the intermediate stacker 301 fall over the intermediate stacker 301. When the leading edge has come in contact with the leading edge hitting plate 302 at the end of the intermediate stacker 301, the leading edges are kept in alignment, and the side edges are aligned by the rocking edge guide 303, whereby a bundle of sheets with the edges kept in alignment is produced.

The intermediate stacker 301 moves from the solid line position of the drawing to the dotted position by the intermediate stacker moving section 304. The leading edge hitting plate 302 located on the leading edge of the intermediate stacker 301 capable of rotation and traveling moves downward when located as the dotted position. The intermediate stacker moving section 304 is made of a drive pulley, a driven pulley, and a belt applied onto these pulleys and driven by them. The ellipse shown by a one-dot chain line indicates the rotary locus of the belt. The belt is connected to the end of the intermediate stacker 301. Under the control of the control section C2, the intermediate stacker 301 can be stopped at a position predetermined to allow stitching operations to be made by the stitching section 500.

The stitching section 500 is a stapler as a commonly known engineering mechanism, and uses a wire staple to stitch at a predetermined position of the bundle of sheets. As a stitching section, it is possible to use a commonly known mechanism wherein the edges of the bundle of sheets are stitched by a stitching tape T coated with a hot-melt paste.

The bundle of sheets on the aforementioned intermediate stacker 301 having stopped immediately close to the stitching section 500 falls off the intermediate stacker 301 when the leading edge hitting plate 302 moves downward, and the leading edge hits the leading edge regulating plate 501 of the stitching section 500, whereby the leading edges of sheets are aligned.

The aforementioned bundle of sheets with the edges aligned in position is sandwiched by the sheet bundle holding section (not illustrated) and is subjected to a process of stitching.

Upon completion of the process of stitching by the stitching section 500, the intermediate stacker 301 moves upward to receive the sheets P constituting the bundle of sheets to be subjected to the next process of stitching.

The unstitched edge of the bundle of sheets having been subjected to the process of stitching is mounted on the third conveying section 600 as a belt type conveying section because the intermediate stacker 301 moves upward. Then the bundle of sheets is released from the sheet holding section, and is stacked on the third conveying section 600. The bundle of sheets is finally ejected to the sheet ejection tray 700.

The sheet ejection tray 700 movable in the vertical direction pertains to a commonly known engineering mechanism. The position of the top surface of the tray, or the topmost surface of the sheet if the sheet or the bundle of sheets is placed on the tray is controlled by a control section C2 in such a way that the sheets or the bundles of sheets ejected from the first or second conveying section are sequentially stacked.

Figure 4:
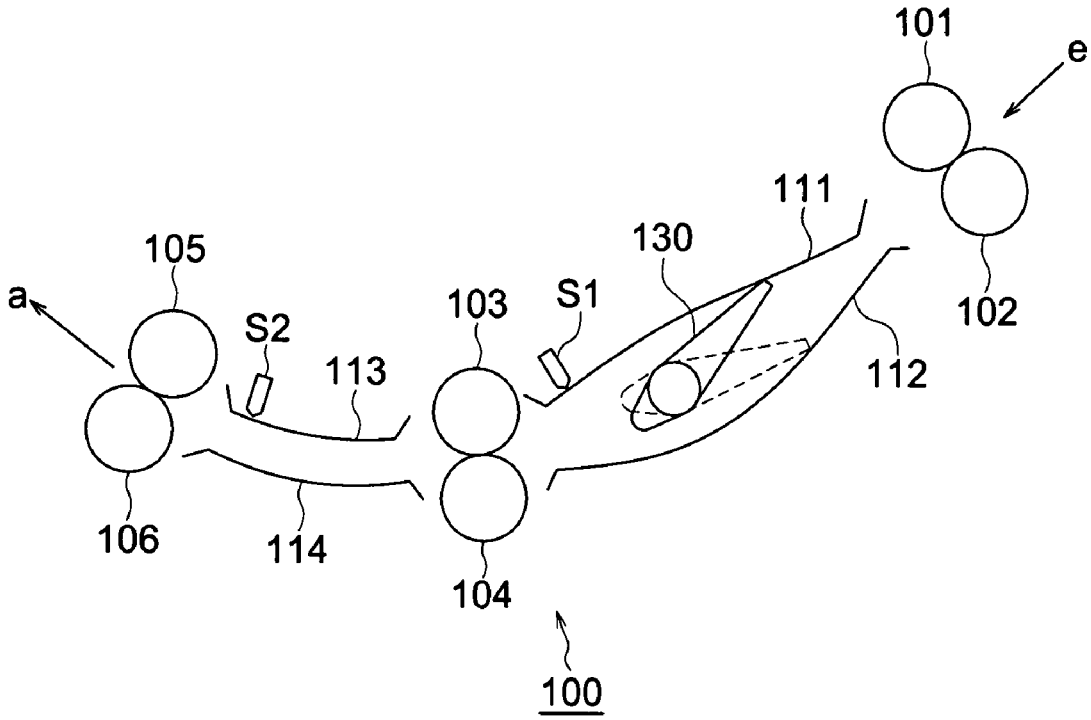
FIG. 4 is a conceptual diagram representing a first conveying section.

FIG. 4 is a conceptual diagram representing the first conveying section 100.

The first conveying section 100 is made up of a plurality of conveying rollers 101, 102, 103, 104, 105 and 106, a plurality of guide members 111, 112, 113 and 114, a switching gate 130, and sheets detecting sensor S1.

The conveying roller 103 is capable of changing the pressing force between opposing rollers. The sheets detecting sensor S1 can also be changed to S2.

The sheets P fed to the first conveying section 100 by the sheet conveyance path switching member 120 are fed from the arrow "e" by the conveying rollers 101 through 106 and are ejected toward the arrow "a". These sheets are sequentially stacked on the intermediate stacker 301, whereby a bundle of sheets is formed.

If a process of stitching has been applied to the preceding bundle of sheets and the succeeding sheet P cannot be sent out to the intermediate stacker 301, a pair of conveying rollers such as the conveying rollers 105 and 106 are placed in the suspend state, and the leading edge of the first sheet P as the first page of the succeeding bundle of sheets having been conveyed by the conveying rollers 101, 102, 103 and 104 hits the nip inlet of the conveying rollers 105 and 106. In this case, the switching gate 130 is located at the solid line position, and the sheets travels below the switching gate 130.

To meet this situation, the conveying rollers 103 and 104 are provided with the power sufficient to convey the sheets P. When the leading edge of the sheet P has hit the conveying rollers 105 and 106, a slip occurs between the sheet P and conveying roller 103, whereby further conveyance is disabled.

The leading edge of the second sheet P having been fed is led toward the guide member 111 located upward when the switching gate 130 located at the solid line position has been switched to the dotted position. Thus, the sheets are conveyed so that the leading edge does not hit the trailing edge of the first sheet waiting on the sheet conveyance path.

To ensure that the process of stitching the preceding bundle of sheets terminates, and the sheet P constituting the next bundle of sheets can be received by the intermediate stacker 301 before the leading edge of the second sheet P having been conveyed reaches the conveying rollers 105 and 106, balance is maintained between the processing capacity of the image forming apparatus G and that of the sheet post-processing apparatus.

Thus, rotation of the conveying rollers 105 and 106 can be started, immediately before the leading edge of the second sheet P reaches the conveying rollers 105 and 106.

The first sheet P in the standby state on the sheet conveyance path of the conveying section 100 and the second sheet having been fed get placed one on top of the other, and they are fed out to the intermediate stacker 301 by the rotation of the conveying rollers 105 and 106 as they are.

In the conventional image forming apparatus, the upper side of the first sheet P to be fed out may be damaged or contaminated by the conveying roller 103 which is rotating when the sheet is in the standby state.

Figure 5:
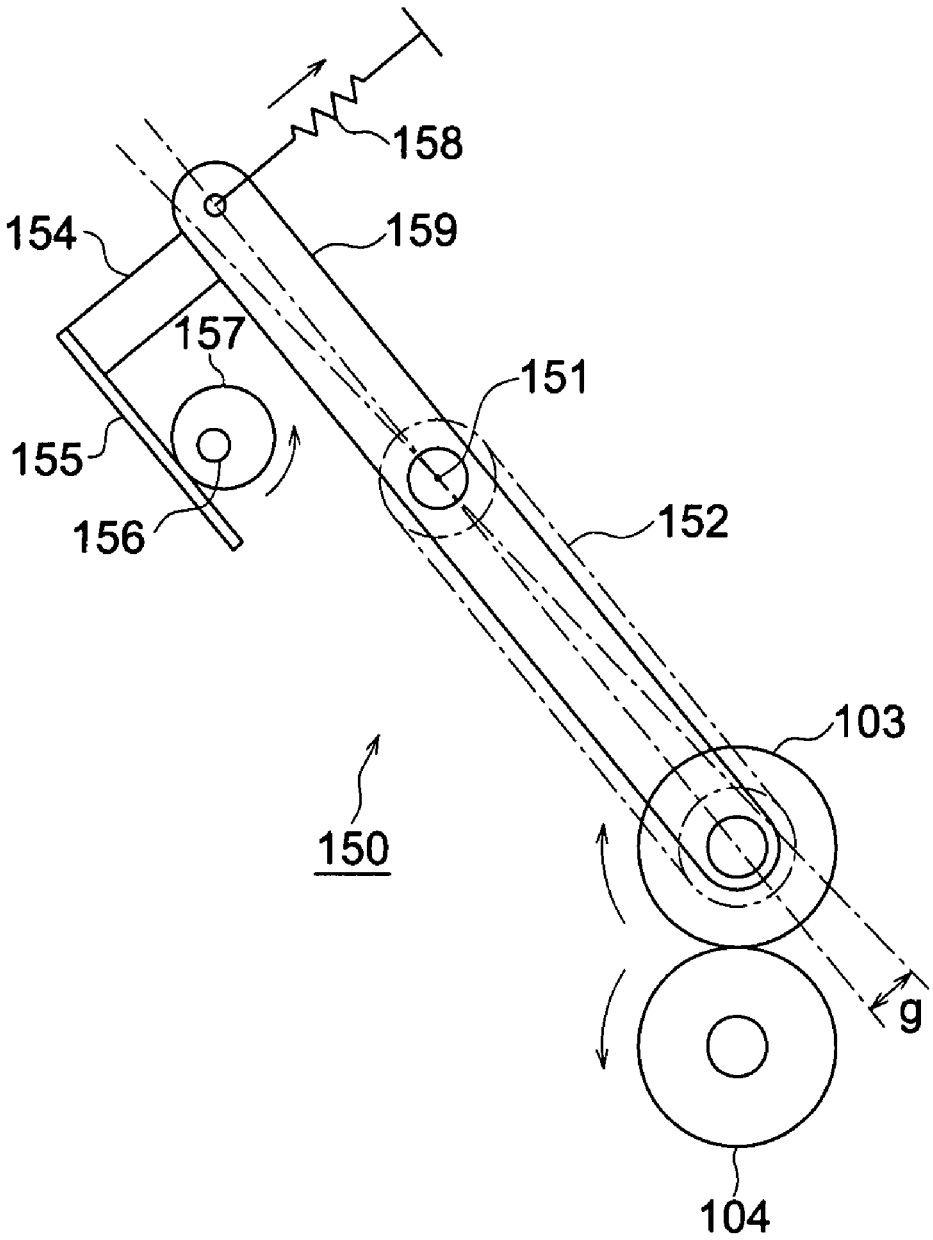
FIG. 5 is a diagram explaining the pressing force changing section.

FIG. 5 is a diagram explaining the pressing force changing mechanism 150 for changing the pressing force of the conveying roller 103 as a conveying roller for adjusting the pressing force.

The pressing force changing mechanism 150 includes a rotating member 159, pressure spring 158, fitting member 154, plate spring 155, cam 157, stepping motor (not illustrated) and others.

The conveying roller 103 is mounted on one end of the rotating member 159 that rotates about the fulcrum 151 as indicated by the arrow "g" and is driven and rotated by the drive belt 152.

The pressure spring 158 is mounted on the other end of the aforementioned rotating member 150, and the conveying roller 103 is pressed against the conveying roller 104.

Further, the aforementioned rotating member 159 is fitted with a plate spring 155 through the fitting member 154, and the plate spring 155 is kept in contact with the cam 157 rotating about the rotary shaft 156.

The suppressing force of the conveying roller 103 against the conveying roller 104 is adjusted according to the stop position of the cam 157. The stop position of the cam 157 is adjusted through the position control of the stepping motor SM (illustrated in FIG. 2 not in FIG. 5) which is driven and controlled by the control section C2.

Figure 6:
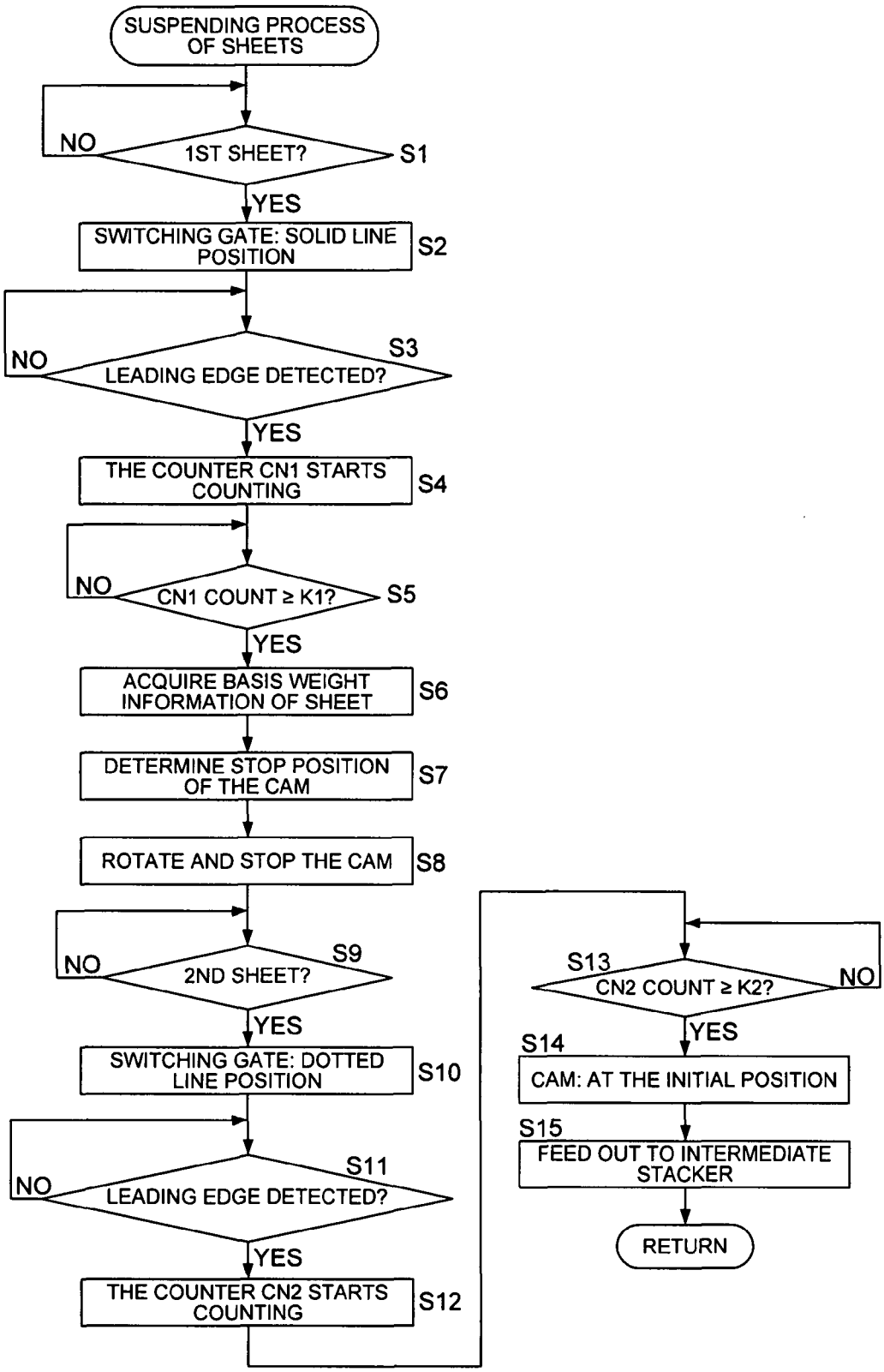
FIG. 6 is a flow chart representing the flow of the suspending process of sheets.

FIG. 6 is a flow chart representing the flow of the suspending process of the sheets.

When a process of stitching is applied to the preceding bundle of sheets, the first sheet P of the succeeding bundle of sheets fed to the sheet conveyance path by the conveying rollers 101 and 102 passes through the sheet conveyance path, guided by the switching gate 130 located at the solid line position of FIG. 4 (Step S1: Y, S2).

After the leading edge of the traveling sheet P has been detected by the sheets detecting sensor S1 (Step S3), the sheet P is further fed by the rotating conveying rollers 103 and 104 to hit the portion close to the nip of the conveying rollers 105 and 106 which are at a standstill.

Upon receipt of the detection signal from the aforementioned sheet leading edge detecting sensor S1 (Step S3: Y), the control section C2 allows the counter CN1 to count the pulses (Step S4).

When the count of the counter CN1 has reached the preset value K1 (Step S5: Y), the control section C2 receives from the control section C1 information on the basis weight of the sheets inputted through the operation and display section E (Step S6) when the user loads the image forming apparatus G with paper P. Then the control section C2 determines the cam stop position by referring to the basis weight-pressing force table representing the relationship between a preset basis weight of sheets and a cam stop position (Step S7).

Then the control section C2 controls the drive of the stepping motor SM and rotates the cam 157 to the predetermined stop position (Step S8).

The aforementioned value K1 is set to the time from detection of the leading edge of the traveling sheet P by the aforementioned sheets detecting sensor S1 to arrival at the nip inlet of the conveying rollers 105 and 106 (a first setting time).

It should be noted that the stop position of the cam 157 determined by the aforementioned basis weight-pressing force table is determined in advance with respect to the basis weight (thickness) of the sheet P according to experiments.

For example, the pressing force of 140 through 180 gf with respect to the basis weight of 50 through 161 g/square meter, and the pressure of 200 through 300 gf with respect to the basis weight of 162 through 254 g/square meter are registered in the aforementioned basis weight-pressing force table. The stop position of the cam 157 for providing these pressures is found out by experiments, and the result is stored in the memory.

Thus, the stop position of the cam 157 can be determined based on the information on the basis weight of the sheet P.

The stop position of the aforementioned cam 157 is where the pressure that can be given to the sheet P is minimized (a first value), on condition that the conveying force by the conveying roller 103 is not zero. This position provides a small pressure that does not damage or contaminate the sheet P even if the conveying roller 103 continues rotating.

As described with reference to Step S7, in the present invention, the damage or contamination of the sheet surface is prevented by reducing the aforementioned pressing force that may change according to the basis weight (thickness) of paper P.

The first paper P is kept at the aforementioned status and goes into the standby state on the sheet conveyance path immediately upstream from the intermediate stacker 301.

When the second sheet P has been fed into the sheet conveyance path (Step S9: Y) by the conveying rollers 101 and 102 of the first conveying section 100, the switching gate 130 of FIG. 4 is switched to the dotted position (Step S10), and the second sheet P is led so that its leading edge does not contact the trailing edge of the first sheet P in the standby state.

When the leading edge of the second sheet P has been detected by the sheet leading edge detecting sensor S1 (Step S11: Y), the counter CN2 starts to count the pulses (Step S12).

When the count of the counter CN2 has reached the preset value K2 (Step S13: Y), the control section C2 controls the drive of the stepping motor SM, whereby the cam 157 is set back to the initial position (Step S14).

The aforementioned value K2 is set at the value corresponding to the time for the leading edge of the second traveling sheet to reach the vicinity of the conveying rollers 105 and 106 (a second setting time).

The initial position wherein the cam 157 stops is where the sheet P is conveyed. Normally, it is where the pressure of the conveying roller 103 against the conveying roller 104 is maximized (a second value).

When the pressure of the conveying roller 103 against the conveying roller 104 is applied, the conveying rollers 105 and 106 rotate, and the first sheet P in the standby state and the second sheet P placed thereon are sent to the intermediate stacker by the conveying rollers 105 and 106 and the conveying rollers 103 and 104.

As described above, in the sheet post-processing apparatus that allows the sheets forming the succeeding bundle of sheets to be in the standby state on the sheet conveyance path while the process of stitching is applied to the preceding bundle of sheets, the damage or contamination possibly resulting from the conveying roller can be avoided.

What is claimed is:

1. A sheet post-processing apparatus which executes a post-process on a sheet bundle, the sheet post-processing apparatus comprising:

a post-processing device for executing the post-process on the sheet bundle;

an intermediate stacker which is provided upstream of the post-processing device in a sheet conveyance direction for stacking sheets to be post-processed;

a first conveying roller (103) which is provided upstream of the intermediate stacker in the sheet conveyance direction, a pressing force of the first conveying roller (103) against a facing roller being variable; and a controller for controlling the pressing force of the first conveying roller (103), wherein after a leading edge of a first sheet to be assigned to a succeeding sheet bundle goes through the first conveying roller (103) while the post-processing device executes the post-process on a preceding sheet bundle, the controller changes a pressing force of the first conveying roller (103) from a first pressing force to a second pressing force which is smaller than the first pressing force, and then the controller changes the pressing force of the first conveying roller (103) to the first pressing force after a leading edge of a second sheet to be assigned to the succeeding sheet bundle goes through the first conveying roller (103).

2. The sheet post-processing apparatus of claim 1, wherein the controller controls the pressing force of the first conveying roller (103) based on information of a basis weight of the sheet.

3. The sheet post-processing apparatus of claim 1, wherein the controller controls the first conveying roller (103) so that the first sheet is suspended upstream of the intermediate stacker during the post-process on the preceding sheet bundle, and the first and second sheets are conveyed onto the intermediate stacker after the second sheet is stacked on the first sheet.

4. The sheet post-processing apparatus of claim 1, comprising:

a pair of second and third conveying rollers (105, 106) which are provided between the first conveying roller (103) and the intermediate stacker and are driven and stopped, wherein the first sheet to be assigned to the succeeding sheet bundle is suspended with the leading edge of the first sheet being in contact with the pair of second and third conveying rollers (105, 106) which are stopped.

5. The sheet post-processing apparatus of claim 1, comprising:

a switching gate which is provided upstream of the first conveying roller (103) in the sheet conveyance direction, wherein the switching gate switches a direction of the switching gate after the leading edge of the first sheet to be assigned to the succeeding sheet bundle goes through the switching gate and before the leading edge of the second sheet to be assigned to the succeeding sheet bundle goes through the switching gate.

6. The sheet post-processing apparatus of claim 1, wherein the second pressing force has such a magnitude that the first pressing force is strong enough to convey a sheet, and when the sheet is suspended after the sheet goes through the first conveying roller (103), the first conveying roller (103) slips on the sheet.

7. The sheet post-processing apparatus of claim 1, comprising:

a pressing force changing mechanism for changing the pressing force of the first conveying roller (103) under control of the controller, the mechanism including:

a rotating member which supports the first conveying roller (103) at a first end side thereof and rotates about a fulcrum;

a cam which is provided being coupled with a second end side of the rotating member and rotates the rotating member by turning around; and a motor which turns the cam.

8. A sheet post-processing apparatus which executes a post-process on a sheet bundle, the sheet post-processing apparatus comprising:

a post-processing device for executing the post-process on the sheet bundle;

an intermediate stacker which is provided upstream of the post-processing device in a sheet conveyance direction for stacking sheets to be post-processed;

a first conveying roller (103) which is provided upstream of the intermediate stacker in the sheet conveyance direction, a pressing force of the first conveying roller (103) against a facing roller being variable;

a controller for controlling the pressing force of the first conveying roller (103); and a pair of second and third conveying rollers (105, 106) provided between the first conveying roller (103) and the intermediate stacker and configured to be driven and stopped, wherein after a leading edge of a first sheet to be assigned to a succeeding sheet bundle goes through the first conveying roller (103) while the post-processing device executes the post-process on a preceding sheet bundle, the controller changes a pressing force of the first conveying roller (103) from a first pressing force to a second pressing force which is smaller than the first pressing force so that the first sheet is stopped with the leading edge thereof being in contact with the pair of second and third conveying rollers (105, 106) while the pair of second and third conveying rollers (105, 106) are stopped, and then the controller changes the pressing force of the first conveying roller (103) to the first pressing force after a leading edge of a second sheet to be assigned to the succeeding sheet bundle goes through the first conveying roller (103).

* * * * *